US005194019A

United States Patent [19]

Rose

[11] Patent Number: 5,194,019

[45] Date of Patent: Mar. 16, 1993

[54] MULTIPLY ORIENTABLE MOUNTING ARRANGEMENT

[75] Inventor: Howard W. Rose, Boiling Springs, Pa.

[73] Assignee: AMP Incorporated, Harrisburg, Pa.

[21] Appl. No.: 872,487

[22] Filed: Apr. 23, 1992

[51] Int. Cl.[5] ..... H01R 13/73

[52] U.S. Cl. ..... 439/569; 439/573; 248/558

[58] Field of Search ..... 439/569, 573, 570, 562, 439/563, 564, 79, 907; 248/558

[56] References Cited

U.S. PATENT DOCUMENTS 3,904,266 9/1975 Fitzpatrick ..... 439/570

*Primary Examiner*—Gary F. Paumen

[57] ABSTRACT

A multiply orientable mounting arrangement wherein intersecting channels are formed in a block (14) by molding the block with a cavity (24) comprising first and second portions (26, 28). Each cavity portion is formed with angularly displaced sides (pb 42, 44; 46, 48) which each partially defines one of the channels. The sides of one of the cavity portions, when taken in conjunction with the sides of the other cavity portion, complete the definition of the sides of the channels. A mold core pin (50) for forming the cavity portions is also disclosed.

5 Claims, 4 Drawing Sheets

MULTIPLY ORIENTABLE MOUNTING ARRANGEMENT

BACKGROUND OF THE INVENTION

This invention relates to the mounting of a body to a support in a selected one of two angularly displaced orientations and, more particularly, to an improved structure for effecting this function, which structure is readily adapted to be made by a side ejection molding process.

The present invention finds particular utility in the molding of an electrical connector receptacle body which is selectively mountable in two angularly displaced orientations about a longitudinal axis through the connector receptacle body. Such a connector is used in certain applications where it can be selectively mounted either as a card edge connector or a panel mount connector. The connector typically includes a pair of mounting ears which extend from opposite ends of the receptacle body along its longitudinal axis. Mounting of the connector receptacle body is commonly effected by using threaded fasteners which extend through appropriately formed and directed holes in the mounting ears. In the past, when the connector receptacle was designed to be selectively utilizable in two different angularly displaced orientations about its longitudinal axis, this required that holes be drilled through the mounting ears in two different directions. This is disadvantageous in that additional manufacturing steps are required after the connector receptacle itself is made.

Since the connector receptacle body, along with the mounting ears, is typically molded as a unitary plastic piece, it would be desirable to be able to form two angularly displaced fastener channels through the mounting ears as part of the molding step. However, it has heretofore not been possible, with a simple side ejection mold, to form two such angularly displaced channels through a body. It is therefore an object of the present invention to provide mounting structure of the type described which may be manufactured by side ejection molding.

It is another object of the present invention to provide a mold for forming such structure.

SUMMARY OF THE INVENTION

The foregoing, and additional, objects of this invention are attained by providing a mounting ear which comprises a block extending along the axis of rotation of the body which is to be secured to a support in a selected one of two orientations which are angularly displaced by a first angle relative to each other. The block is formed with a cavity comprising first and second portions, with the first cavity portion being open to the exterior of the block in a first region and the second cavity portion being open to the exterior of the block in a second region. The first and second cavity portions each has a pair of sides extending to the exterior of the block, with the pair of sides of each cavity portion being angularly displaced relative to each other by the first angle and each of the sides of a first cavity portion being parallel to a respective side of the other cavity portion. The first and second cavity portions are connected so that the cavity formed by the first and second cavity portions provides a pair of elongated intersecting channels each defined by a respective pair of parallel sides of the first and second cavity portions. The channels are angularly displaced by the first angle relative to each other and are orthogonal to the axis of rotation, each channel extending through the axis of rotation to the exterior of the block along a respective channel longitudinal axis.

In accordance with an aspect of this invention, there is provided a side ejection mold for forming such a cavity. The mold includes first and second mold core pins adapted for reciprocating motion along a first axis. The first mold core pin has a pair of sides angularly displaced relative to each other around the first axis by the first angle for forming sides of the channels. The first mold core pin has a first surface at the intersection of its sides which is transverse to its sides. Likewise, the second mold core pin has a pair of sides angularly displaced relative to each other around the first axis by the first angle for forming sides of the channels. The second mold core pin has a second surface at the intersection of its sides which is transverse to its sides. The first and second surfaces of the two mold core pins are mutually complementary so that when the first and second mold core pins are moved toward and into contact with each other along the first axis, the first and second surfaces become aligned and in superposed abutting relationship and pairs of the sides become parallel.

In accordance with another aspect of this invention, the projections of the first and second surfaces onto planes orthogonal to the sides are circular so that each of the channels has an overall circular cross section when viewed from either of its ends at the exterior of the block.

BRIEF DESCRIPTION OF THE DRAWINGS

The forgoing will be more readily apparent upon reading the following description in conjunction with the drawings in which like elements in different figures thereof have the same reference numeral and wherein.

DETAILED DESCRIPTION

Figure 1:
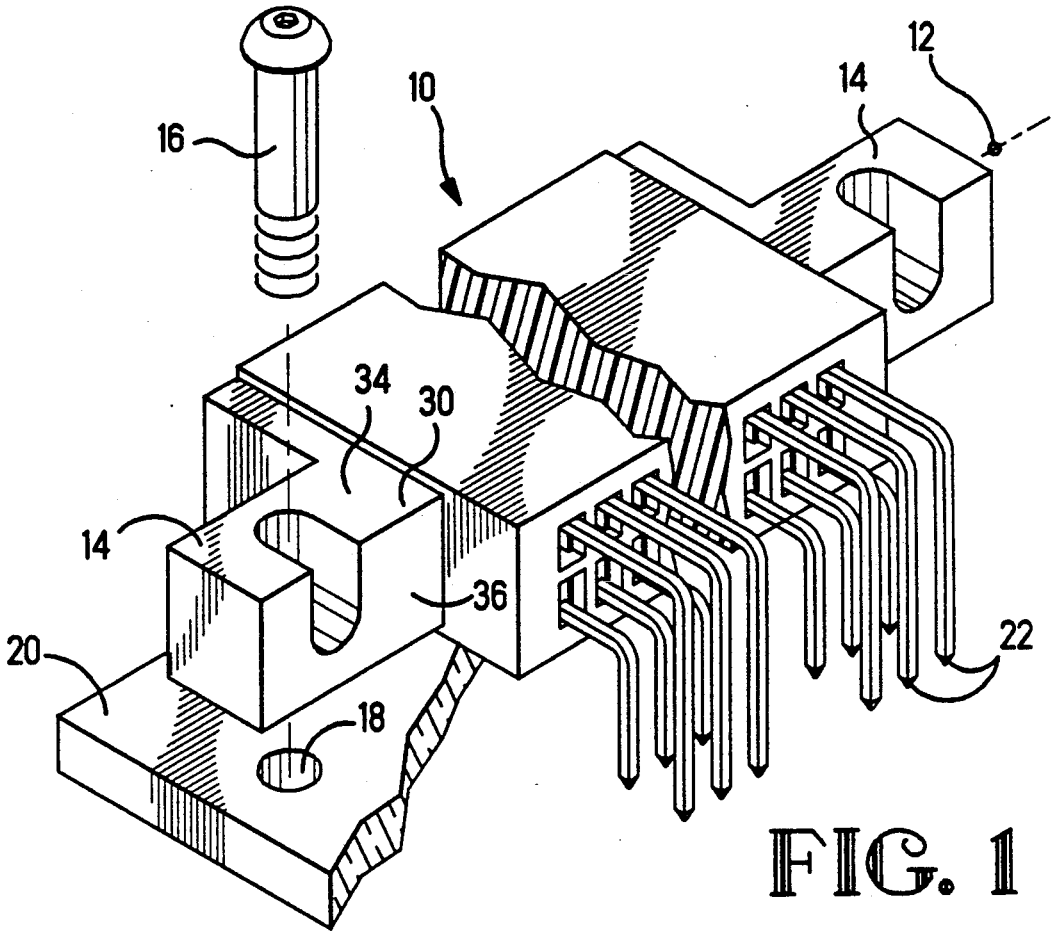
FIG. 1 is a top perspective view of a connector receptacle having mounting ears and constructed according to this invention, showing how the receptacle is mounted in a first orientation to a printed circuit board.

Referring to the drawings, FIG. 1 shows an electrical connector receptacle designated generally by the reference numeral 10 and constructed according to this invention. The receptacle 10 is adapted to be mounted in a selected one of two orientations which are angularly displaced relative to each other about an axis of rotation 12, which axis illustratively passes through the body of the receptacle 10. Illustratively, the two orientations are mutually orthogonal, but the present invention is not limited to the specific 90° angle. As shown, a pair of mounting ears 14 extend outwardly from opposite ends of the body of the receptacle 10 along the axis 12. Each of the ears 14 is formed with channels to accept therethrough a fastening member, illustratively a threaded bolt 16, which then extends through a properly positioned aperture 18 on a printed circuit board 20 and is held by a nut (not shown) on the other side of the board 20. In this mounting orientation, right angle pins 22 extend out of the receptacle 10 for securement to the printed circuit board 20, in a conventional manner.

Figure 2:
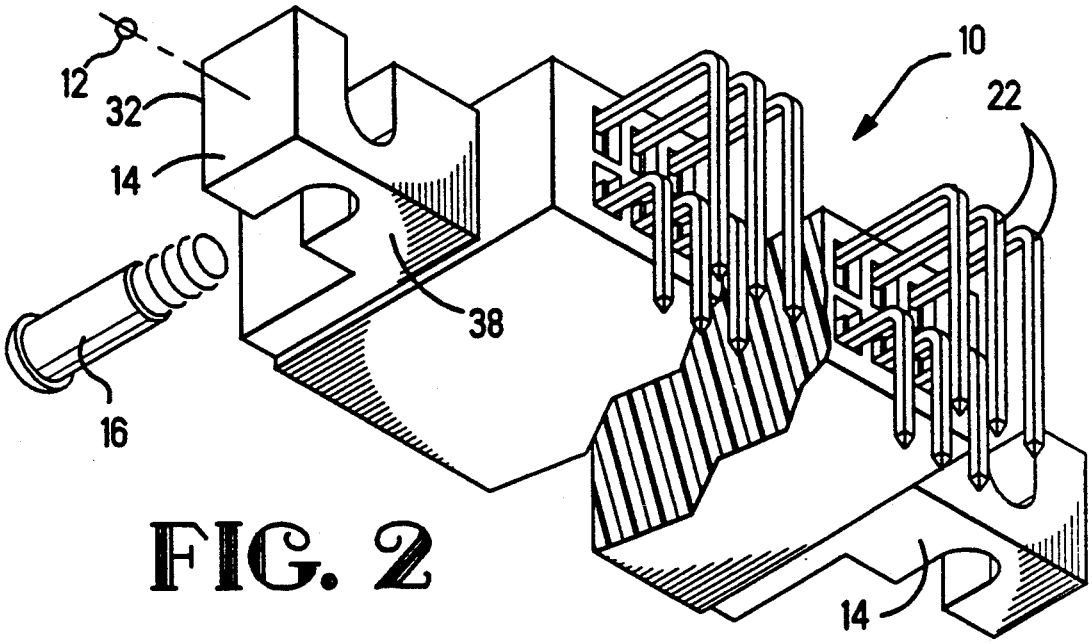
FIG. 2 is a bottom perspective view of the connector receptacle shown in FIG. 1 showing how the receptacle is mounted in a second orientation orthogonal to the first orientation.

Alternatively, the receptacle 10 may be mounted to a support, such as in a panel mounting arrangement, which is oriented relative to the board 20 shown in FIG. 1 orthogonally about the axis 12 from the orientation shown in FIG. 1. In such a mounting arrangement, as shown in FIG. 2, the fasteners 16 would extend through the mounting ears 14 in a relative direction which is orthogonal to the direction shown in FIG. 1. Therefore, to allow the receptacle 10 to be mounted in either one of the two possible orientations, the mounting ears 14 must be formed with orthogonal intersecting channels.

The present invention results in the provision of angularly displaced intersecting channels in the mounting ears 14 in a manner which allows the body of the connector receptacle 10, along with the mounting ears 14, to be molded as a unitary structure by means of a simple side ejection mold. For purposes of illustration, the angular displacement of the intersecting channels is 90°. Also, for purposes of illustration, the mounting ears 14 are shown as being generally rectangular blocks, but other shapes, such as cylindrical blocks, can also be utilized, depending on the particular application of the principles of this invention.

Figure 3:
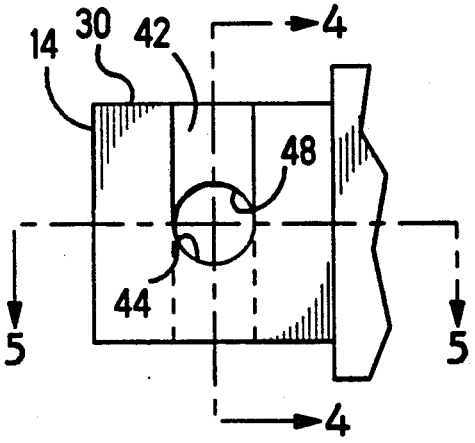
FIG. 3 is a side view of a mounting ear of the receptacle of FIG. 1.
Figure 4:
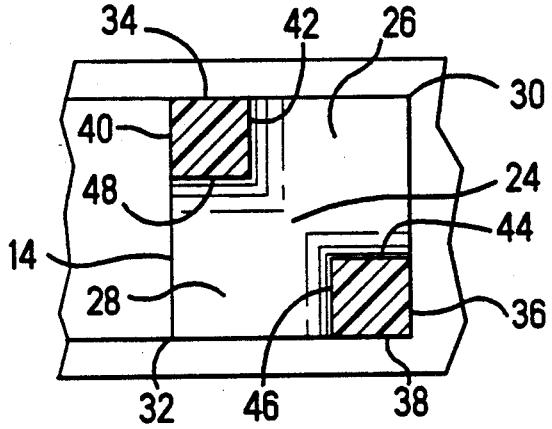
FIG. 4 is a cross sectional view taken along the line 4—4 in FIG. 3.
Figure 5:
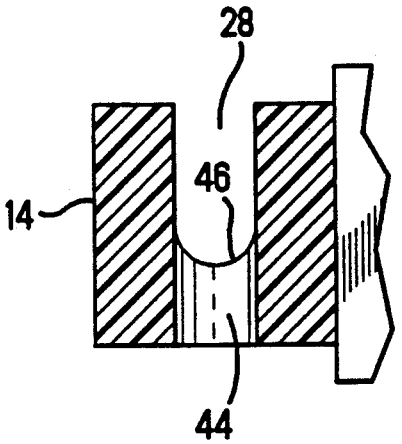
FIG. 5 is a cross sectional view taken along the line 5—5 in FIG. 3.

In order that a side ejection molding operation can be effected, any cavity formed by such operation must be designed without any undercuts in the direction that the mold core pins are moved. As shown in FIGS. 3, 4 and 5, the mutually orthogonal channels for the bolts 16 are provided by forming a cavity 24 in each of the mounting ears 14 which includes a first cavity portion 26 and a second cavity portion 28. Each of the cavity portions 26, 28 is formed by a respective mold core pin, as will be described in full detail hereinafter. Each of the cavity portions 26, 28 is open to the exterior of the mounting ear 14 in a respective first and second region. The first and second regions are across the axis 12 from each other. Illustratively, the mounting ear 14 is formed as a generally rectangular block having a first edge 30 and a second edge 32 which are parallel to the axis 12. The ear 14 is further formed with a first pair of sides 34, 36 which meet at the first edge 30 and a second pair of sides 38, 40 which meet at the second edge 32. The side 34 is across the axis of rotation from the side 38 and the side 36 is across the axis of rotation 12 from the side 40. Thus, the first cavity portion 26 is open along the first edge 30 and the pair of sides 34, 36 and the second cavity portion 28 is open along the second edge 32 and the pair of sides 38, 40.

The first cavity portion 26 has a pair of sides 42, 44 which extend to the exterior of the ear 14 and the second cavity portion 28 has a pair of sides 46, 48 which likewise extend to the exterior of the ear 14. The pair of sides 42, 44 of the first cavity portion 26 are angularly displaced relative to each other by 90°. The pair of sides 46, 48 of the second cavity portion 28 are likewise angularly displaced relative to each other by 90° within the plane of the cavity 24. The side 42 of the cavity portion 26 is parallel to the side 46 of the cavity portion 28 and the side 44 of the cavity portion 26 is parallel to the side 48 of the cavity portion 28. The first and second cavity portions 26, 28 are connected so that the overall cavity 24 provides a pair of elongated intersecting channels defined by the sides 42, 44, 46 and 48. Thus, a first channel is defined by the sides 42 and 46 and a second channel is defined by the sides 44 and 48. FIGS. 3 and 4 show the first channel being oriented vertically through the ear 14 and the second channel being oriented horizontally through the ear 14.

Preferably, each of the cavity portions 26, 28 are C-shaped, with the curved side of the "C" being a semicircle, when viewed in planes orthogonal to the sides 42, 44, 46 and 48 of the cavity portions 26, 28, as is clear from FIG. 5 which shows the C-shape of the cavity portion 28. Accordingly, when each of the channels is viewed from its ends at the exterior of the ear 14, it has an overall circular cross section, as is clear from FIG. 3.

Figure 6:
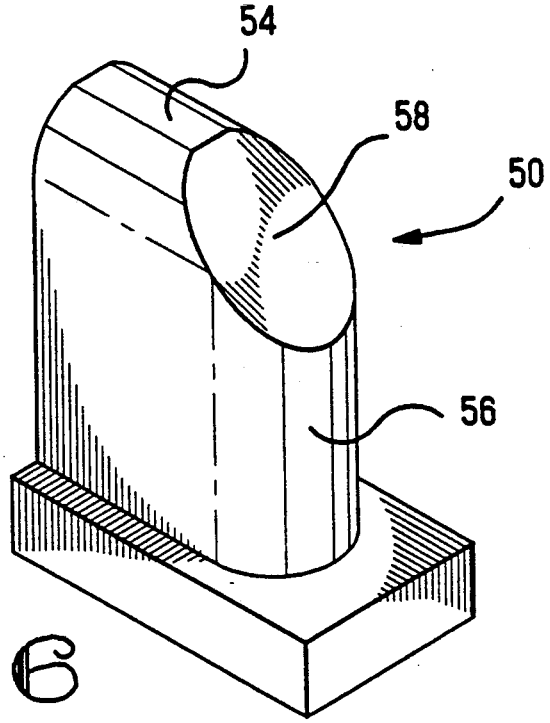
FIG. 6 is a perspective view of a mold core pin constructed according to the principles of this invention for forming one of the cavity portions in a mounting ear of the connector receptacle shown in FIG. 1.

To form the cavity 24 in the ear 14 as part of a side ejection molding process for the connector receptacle 10, there are provided first and second mold core pins 50, 52. The mold pins 50, 52 are preferably identical with the mold core pin 50 being shown in FIG. 6. The mold core pins 50, 52 are adapted to be reciprocated as part of the mold toward and away from each other along a first axis. The mold core pin 50 has a pair of sides 54 and 56 which are angularly displaced relative to each other around that first axis. The sides 54, 56 are used for forming the sides of the intersecting channels. Thus, the side 54 of the first mold core pin 50 is used for forming the side 44 of the first cavity portion 26 and the side 56 of the first mold core pin 50 is used for forming the side 42 of the first cavity portion 26. In the illustrative embodiment shown herein, the side 56 is parallel to the first axis along which the mold core pin 50 moves.

Figure 7:
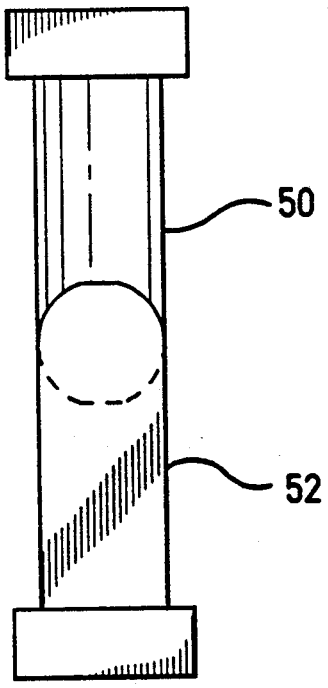
FIGS. 7, 8 and 9 are orthogonally related views of a pair of mold core pins of the type shown in FIG. 6 which are used for forming the cavity in the mounting ear so as to provide a pair of orthogonal intersecting channels therethrough.
Figure 8:
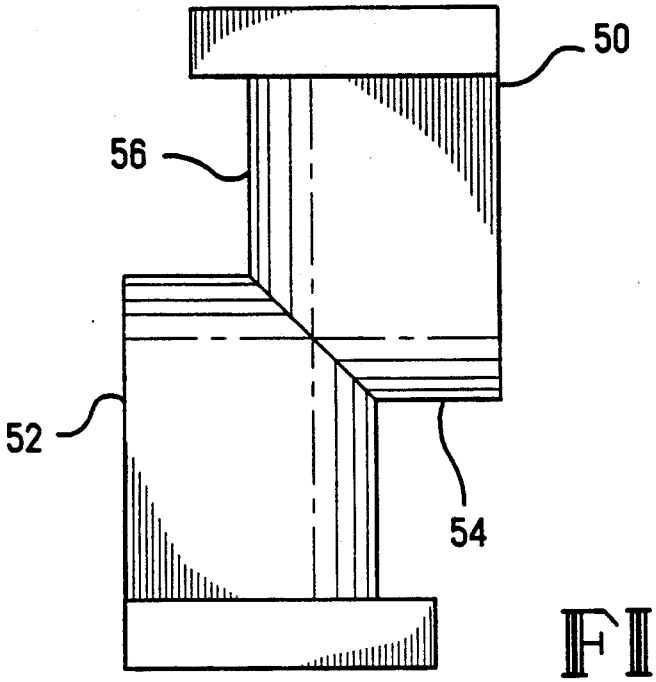
Figure 9:
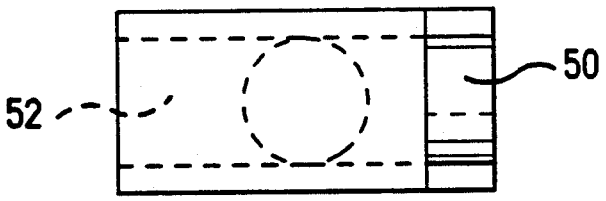

The mold core pin 50 is further formed with a surface 58 at the intersection of its sides 54, 56. The surface 58 is transverse to both the sides 54, 56 and illustratively is a planar surface. Although shown as a planar surface, all that is necessary is that the surface 58 of the first mold core pin 50 and the corresponding surface of the second mold core pin 52 are complementary so that when the mold core pins 50, 52 are moved toward and into contact with each other, those surfaces become aligned and in superposed abutting relationship. Thus, the cavity portions 26, 28 formed by the respective mold core pins 50, 52 become connected to form the overall cavity 24. In the illustrative embodiment where the channels are mutually orthogonal and the surface 58 is planar, the surface 58 is at an angle of 45° to both of the sides 54 and 56. To form the C-shaped cavity portions 26 and 28, the mold core pins 50, 52 are D-shaped in cross section taken in planes orthogonal to their sides. Thus, the surface 58 is elliptical and its projections onto planes orthogonal to the sides 54, 56 are circular, as is clear from FIGS. 7 and 9.

An advantage of this invention is that intersecting channels can be formed in a molded block as part of the molding process using a simple side ejection mold. Thus, the need for a separate drilling step is obviated.

Accordingly, there has been disclosed an improved multiply orientable mounting arrangement which may be made by a side ejection molding process. While an illustrative embodiment has been disclosed herein, it will be apparent to those skilled in the art that various modifications and adaptations to that embodiment are possible, and it is intended that this invention be limited only by the scope of the appended claims.

I claim:

1. An arrangement for securing a body (10) to a support in a selected one of two orientations which are angularly displaced by a first angle relative to each other about an axis of rotation (12), the arrangement comprising:

a mounting ear (14) secured to said body (10), said mounting ear (14) comprising a block extending away from said body (10) and along said axis of rotation (12), said block being formed with a cavity (24) comprising first and second portions (26, 28), the first cavity portion (26) being open to the exterior of said block (14) in a first region, the second cavity portion (28) being open to the exterior of said block (14) in a second region across the axis of rotation (12) from said first region, said first and second cavity portions (26, 28) each having a pair of sides (42, 44; 46, 48) extending to the exterior of said block (14), said pair of sides of each cavity portion being angularly displaced relative to each other within said plane by said first angle, each of said sides (42, 44) of said first cavity portion (26) being parallel to a respective side (46, 48) of said second cavity portion (28), said first and second cavity portions (26, 28) being connected so that said cavity (24) formed by said first and second cavity portions (26, 28) provides a pair of elongated intersecting channels each defined by a respective pair of parallel sides (42, 46; 44, 48) of said first and second cavity portions (26, 28), said channels being angularly displaced by said first angle relative to each other and orthogonal to said axis of rotation (12) and each extending through said axis of rotation (12) to the exterior of said block (14) along a respective channel longitudinal axis.

2. The arrangement according to claim 1 wherein said first and second cavity portions (26, 28) are C-shaped when viewed in planes orthogonal to the sides (42, 44, 46, 48) of said cavity portions (26, 28).

3. The arrangement according to claim 2 wherein each of said channels has an overall circular cross section when viewed from either of its ends at the exterior of the block (14).

4. The arrangement according to claim 1 wherein said block (14) is generally rectangular having first and second edges (30, 32) parallel to said axis of rotation (12), said block (14) having a first pair of sides (34, 36) meeting at said first edge (30) and a second pair of sides (38, 40) meeting at said second edge (32), the sides of said second pair of sides being across said axis of rotation (12) from respective ones of the sides of said first pair of sides, said first cavity portion (26) being open along said first edge (30) of said block (14) and said first pair of sides (34, 36), and said second cavity portion (28) being open along said second edge (32) of said block (14) and said second pair of sides (38, 40).

5. The arrangement according to claim 1 wherein said first angle is 90°.

* * * * *